US006099389A

United States Patent [19]

Nichols et al.

[11] Patent Number: 6,099,389

[45] Date of Patent: Aug. 8, 2000

[54] FABRICATION OF AN OPTICAL COMPONENT

[75] Inventors: Michael A. Nichols, Livermore; David M. Aikens, Pleasanton; David W. Camp, Oakland; Ian M. Thomas, Livermore; Craig Kiikka, Livermore; Lynn M. Sheehan, Livermore; Mark R. Kozlowski, Livermore, all of Calif.

[73] Assignee: The United States of America as represented by the United States Department of Energy, Washington, D.C.

[21] Appl. No.: 09/166,817

[22] Filed: Oct. 5, 1998

[51] Int. Cl.[7] ..... B24B 1/00

[52] U.S. Cl. ..... 451/36; 451/34; 451/37; 451/57

[58] Field of Search ..... 451/57, 34, 37, 451/36

[56] References Cited

U.S. PATENT DOCUMENTS 5,056,270 10/1991 Curcher .
5,384,988 1/1995 Hernandez .
5,876,268 3/1999 Lamphere et al. .
5,888,119 3/1999 Christianson et al. .

*Primary Examiner*—Timothy V. Eley
*Assistant Examiner*—Willie Berry, Jr.
*Attorney, Agent, or Firm*—Gary R. Drew; William C. Daubenspeck; William R. Moser

[57] ABSTRACT

A method for forming optical parts used in laser optical systems such as high energy lasers, high average power lasers, semiconductor capital equipment and medical devices. The optical parts will not damage during the operation of high power lasers in the ultra-violet light range. A blank is first ground using a fixed abrasive grinding method to remove the subsurface damage formed during the fabrication of the blank. The next step grinds and polishes the edges and forms bevels to reduce the amount of fused-glass contaminants in the subsequent steps. A loose abrasive grind removes the subsurface damage formed during the fixed abrasive or "blanchard" removal process. After repolishing the bevels and performing an optional fluoride etch, the surface of the blank is polished using a zirconia slurry. Any subsurface damage formed during the loose abrasive grind will be removed during this zirconia polish. A post polish etch may be performed to remove any redeposited contaminants. Another method uses a ceria polishing step to remove the subsurface damage formed during the loose abrasive grind. However, any residual ceria may interfere with the optical properties of the finished part. Therefore, the ceria and other contaminants are removed by performing either a zirconia polish after the ceria polish or a post ceria polish etch.

20 Claims, 3 Drawing Sheets

FABRICATION OF AN OPTICAL COMPONENT

STATEMENT OF RIGHTS OF INVENTION

The United States Government has rights in this invention pursuant to Contract No. W-7405-ENG-48 between the United States Department of Energy and the University of California.

BACKGROUND OF THE INVENTION

1. Field of the Invention

This invention relates to methods for improving the grinding and polishing of glass, ceramics and semiconductor materials.

2. Description of the Related Art

Referring to FIG. 2A, a blank 2 of fused silica is shown. The subsurface damage layer 6, which contains mainly fractures that have been covered by the polishing re-deposition layer 4, is a likely contributor to laser induced damage. This subsurface damage (SSD) may reduce the strength of the final polished part by providing initiating cracks that reduce fracture strength. SSD may provide sites for light-absorbing contaminants to reside. When these contaminants are at or near fracture surfaces, the atoms are more easily ionizable (by changing the chemical or electronic environment), which can cause larger cracks and fractures. SSD may also modulate locally the electromagnetic field.

Subsurface damage is eliminated or minimized in practice by using a controlled sequence of successively gentler grinding and polishing steps, making sure that each step removes enough material to eliminate damage produced by the previous step. Studies of the effect of subsurface damage on laser damage threshold have primarily been at longer wavelengths than 355 nm. The characteristics of laser induced damage are better understood at these longer wavelengths; therefore, grinding and polishing methods of the prior art have been successful. However, the characteristics of laser induced damage at shorter wavelengths is not well understood in the prior art.

The laser induced damage threshold of fused silica and calcium fluoride optics is an area of critical importance to the high energy fusion laser community and the multi-billion dollar semiconductor capital equipment market. In the lithography equipment for manufacturing of silicon chips, a UV light in the range of 340–360 nm is primarily used. However, manufacturers would like to use shorter wavelengths such as 193 nm and 248 nm. These UV wavelengths are becoming common in biomedical devices as well. All of these wavelengths are produced by a series of UV lasers, and imaged through fused silica and CaF optics, which are susceptible to laser induced damage. Unfortunately, present grinding and polishing techniques can not produce quality optics to be used with these short wavelengths.

SUMMARY OF THE INVENTION

An object of the invention is to grind and polish substrates used in optics such that the polished surfaces can survive a high power density of ultra-violet irradiation.

An other object of the invention is to manufacture high energy laser components for UV/DUV/EUV lithography especially in semiconductor manufacturing.

The present invention discloses a method of grinding a blank using a fixed abrasive removal (also known as a Blanchard removal) to remove the subsurface damage formed during the fabrication of the blank. The next step grinds and polishes the edges and forms bevels to reduce the amount of contaminants in the subsequent steps. A loose abrasive grind removes the subsurface damage formed during the fixed abrasive removal process. After performing an optional fluoride etch, the bevels should be repolished. The surface of the blank is polished using a zirconia slurry. Any subsurface damage formed during the loose abrasive grind will be removed during this zirconia polish. A post polish etch may be performed to remove any redeposited fused silica and contaminants.

The present invention also discloses polishing the surface of the blank with ceria to remove the subsurface damage formed during the loose abrasive grind. However, any residual ceria may interfere with the optical properties of the finished part, therefore the ceria and other contaminants are removed by performing either a zirconia polish after the ceria polish or a post ceria polish etch.

Other objects and advantages of the present invention will become apparent when the apparatus of the present invention is considered in conjunction with the accompanying drawings, specification, and claims.

BRIEF DESCRIPTION OF THE DRAWINGS

For a better understanding of the invention and further features thereof, reference is made to the following detailed description of the invention to be read in connection with the accompanying drawing wherein.

DESCRIPTION OF THE PREFERRED EMBODIMENT

While this invention is described in some detail herein, with specific reference to illustrated embodiments, it is to be understood that there is no intent to be limited to these embodiments. On the contrary, the aim is to cover all modifications, alternatives and equivalents falling within the spirit and scope of the invention as defined by the claims. For example, fused silica parts are being polished in these embodiments. However, this process could also be used for CaF optics.

Figure 1:
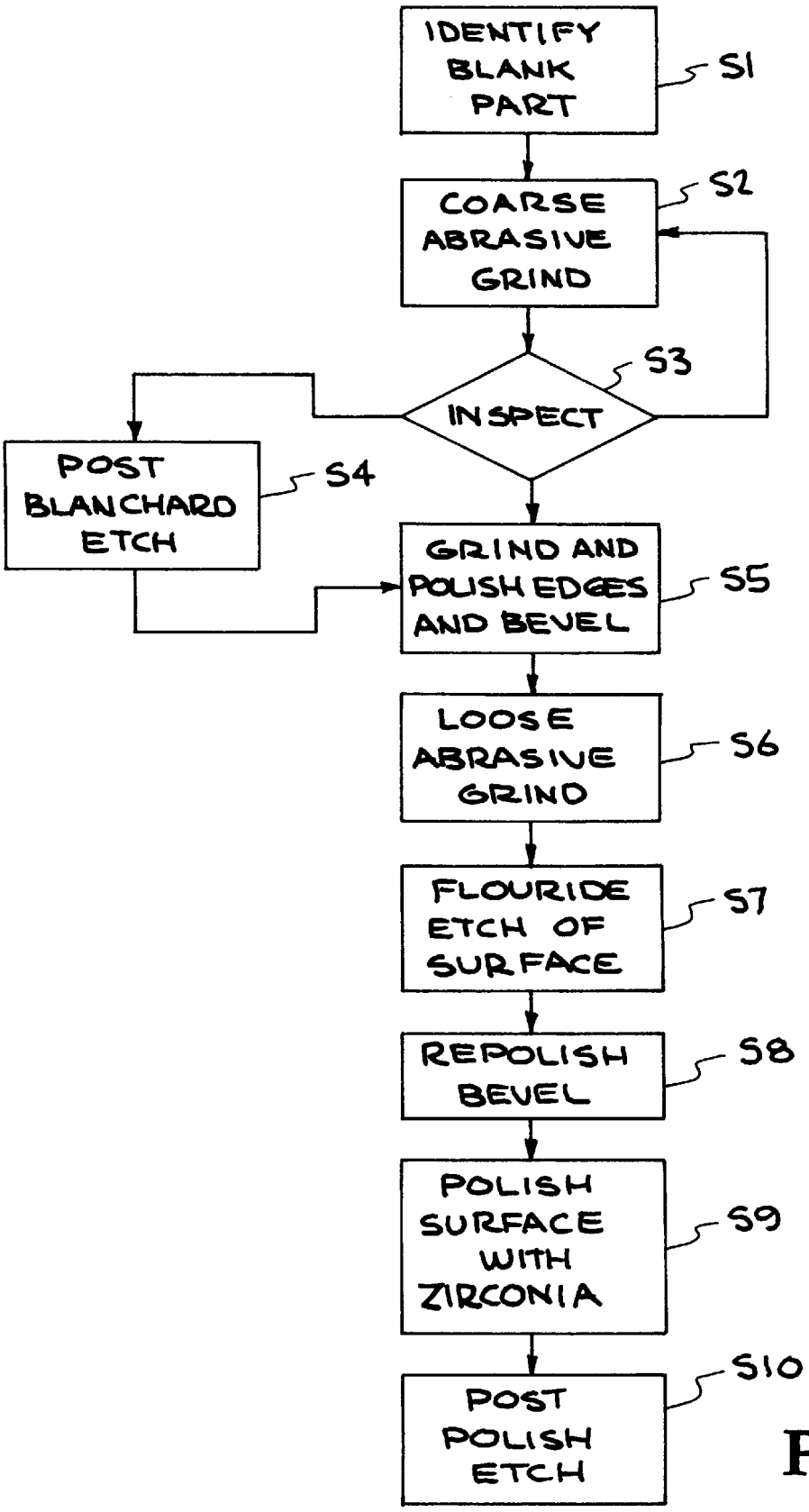
FIG. 1 is a flow diagram of the process used in the first preferred embodiment of the present invention.

Referring to FIG. 1, a flow diagram of the process of the first preferred embodiment of the present invention is shown. As a preliminary caution, after each step there must be no harmful scratches, fractures, stressed regions, or any kind of subsurface damage left over from the previous grinding or etching steps. In addition, all unwanted contaminants or alterations of glass chemistry left over from the previous grinding or etching steps should be removed. Therefore, a controlled sequence of grinding and polishing is performed to make sure that each step assures complete elimination of all damage and contaminants from the previous step. The depth of removal for each step must go below any subsurface damage produced by the previous step, plus it must not propagate, or "chase" any previous fractures deeper into the glass.

Each grinding and polishing step is done using conservative, gentle operating parameters. For example, relatively soft matrix and slow downfeed rates are used for fixed abrasive grinding, and relatively soft lap materials and light weighting are used for loose abrasive grinding. Care must be taken to avoid unusually large local particle-part forces that would cause excessive scratching or fracturing, such as from "thrown" diamonds or much-larger-than-average abrasive particles or part chips.

Referring to FIG. 1, a blank of fused silica, which is a part to be polished, is tracked by using an identifying code in step S1. The tracking information may assist in determining the depth of grinding and polishing in the subsequent steps because blanks from the same lot usually have similar polishing requirements. In other words, blanks from a different lot may require different grinding and polishing depths. The tracking information can include vendor name, grade purchase order, vendor inspection information, etc. This step may be skipped depending on the quantity of blanks to be ground and polished.

In step S2, a coarse grind of the blank is performed. The surfaces of the blanks from a vendor have typically been either saw cut or generated with a rough fixed abrasive wheel. Depending on the quality of the initial blank, most blank SSD is less than 250 $\mu$m deep. However, it is preferable to remove approximately 500 $\mu$m of the surface by a coarse fixed abrasive grind. As an alternative, additional removal of the blank's surface could be performed to reach a desired part thickness. To grind the blank, for example, a 100 grit diamond resin bond abrasive wheel can be operated at 0.003 inch/minute down feed rate and 24 rpm chuck speed. It has been demonstrated that downfeed speeds of higher rates produce deeper "Blanchard lines," which should be avoided.

Figure 2A:
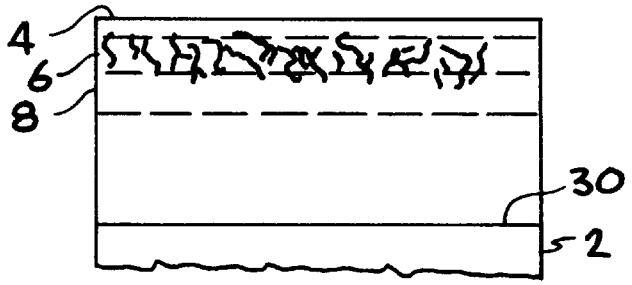
FIGS. 2A–2E depict different stages of the ground and polished fused silica.

Referring to FIG. 2A, the blank 2 (also referred to as a part) of fused silica has subsurface damage layer 6 to a depth of order 100 $\mu$m. The re-deposition layer 4 is usually only between 0.1 and 1 $\mu$m. Due to thermal changes and large pressures applied to the surface of the blank during the initial preparation by the vendor, there may exist a deformation layer 8, which could be as deep as 200 $\mu$m. Therefore, all of this damaged material is removed by the coarse abrasive grinding as shown in FIG. 2A to a new surface level 30.

In step S3 of FIG. 1, the blank should be inspected for fractures, deep scratches, gouges, big chips, etc. If there are any flaws and their associated subsurface damage that will probably not be removed by subsequent processing, the blank should be further ground by the coarse abrasive removal process to an appropriate depth or simply reject the part.

An optional step S4 would be a post-Blanchard etch. This is useful if the coarse abrasive grinding damage was variable from part to part and better early control or inspection of this damage was desired. By determining the depth of the damage, the depth of the fine grind removal may be adjusted. However, this post-Blanchard etch is not necessary.

Figure 2B:
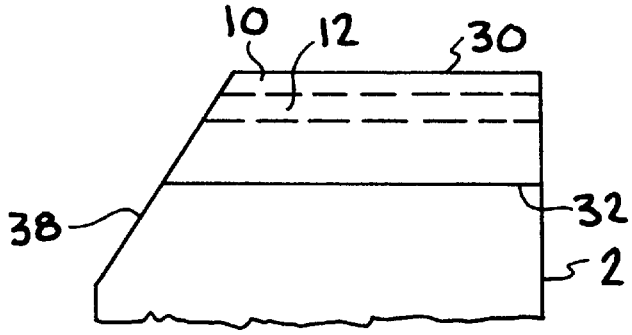

After either the inspection step S3 or the post-Blanchard etch step S4, a bevel 38 is formed between the edge and surface of the part as shown in FIG. 2B. In addition, the edges of the part are ground and polished in step S5 of FIG. 1. There are several polishing processes that can be used to achieve the required surface quality. As an example, the edges of five blanks, which are axially sandwiched together, can be ground using a hand-held copper sheet curved to cup the parts in a K. O. Lee Shaper model B10043M at 360 rpm grinding "lap". The initial grind uses a 30 $\mu$m alumina slurry for ten minutes. Then the grinding is continued with a 9 $\mu$m alumina slurry for five minutes. The final polish "lap" uses a hand-held Buelher Texmet polishing cloth curved to cup the parts and a 1.5 $\mu$m opaline for fifteen minutes.

It is recommended to create a 45 degree polished bevel at the perimeter of each face of the part in order to prevent tiny chips of fused silica from breaking loose during the subsequent fine grinding and polishing processes. These chips, which would most likely be much larger than the grinding and polishing particles, could be dragged along the surface and cause exceptionally deep scratches or subsurface damage. There are many edge leveling processes that can be employed that result in a clean, polished bevel. As an example, an iron beveling cup "lap" with 1.4–1.5 inch radius can be used at rotation speed of 120 rpm to form the bevel in the part. After the first 30 $\mu$m alumina slurry is used for 4 minutes, a 9 $\mu$m alumina slurry is used for two minutes. The final polish "lap" of the beveled edges is performed by using hand-held Buelher Texmet polishing cloth curved to cup the parts and a 1.5 $\mu$m opaline for six minutes. The parts should be inspected for chips or fractures before starting the next step.

Polishing the edges is helpful for two reasons: a) weighing of the part to determine the amount of surface removed in each step is not complicated by polishing compound adhering to a rough ground surface; and b) the final cleaning is easier when removing the polishing compound. A ceria polish of the edges and bevels is acceptable even if the final polish will use a zirconia polish slurry because: a) these ceria polished surfaces (edges and bevels) are not part of the optical surface; and b) these surfaces will be etched before the faces are polished.

Referring to FIG. 1, a fine loose abrasive grinding is performed in step S6. It is preferable to remove approximately 250 $\mu$m from the surface. For example, a brass lap at 15 rpm is used with 9 $\mu$m loose alumina. A smaller size particle could be used, but if a contaminant or silica chip is 2–3 times larger than the mean particle size, that contaminant would carry all of the load between the lap and blank such that deep scratches and subsurface damage would result. A suggested slurry would be prepared by combining 400 ml tap water, 40 ml of Everflow or equivalent liquid suspension agent, 20 ml of crystalline sodium citrate and 40 ml of 9 $\mu$m WCA Microgrit or equivalent slurry into a glass spray bottle. The slurry is applied in a fine spray onto the lap for 9 seconds per minute without recycling. With this one-pass system, around 300 ml of slurry will be consumed each hour. In addition, a recommended pressure is approximately 35–40 g/cm$^2$ so that approximately 45 $\mu$m/h of surface is removed.

The brass lap is preferred over a harder ceramic lap for two reasons: 1) the ceramic may chip causing serious gouges and scratches; and 2) the softer brass produces less subsurface damage that would need to be removed in subsequent polishing steps. However, the brass lap may introduce Cu or Zn contamination. Brass is still preferable because these contaminates are usually removed in subsequent polishing. Also, these particular contaminates are not strongly absorbing at wavelengths such as 355 nm; but these contaminates may be a concern depending on the intended use of the polished silica.

Referring to FIG. 2B, the part is shown with a surface 30 from the previous coarse abrasive grinding of step S2. The subsurface damage 12 from the coarse abrasive grind will extend about 50–80 $\mu$m from the surface. Actual particles could be imbedded as far as 30 $\mu$m into the ground layer 10 of part 2. During step S6, 250 $\mu$m of surface is removed to expose a new surface level 32. Referring to FIG. 1, a post grinding etch is performed to remove approximately 80 $\mu$m from the surface in step S7. Depending on the materials being etched and polished, a smaller etch depth may be acceptable. In fact, this etch step could be eliminated. However, there are usually many surface features easily visible even with etchings of only 40 $\mu$m.

This post grinding etch for fused silica, for example, could be a deep fluoride etch of 1% HF and 15% $NH_4F$ solution in deionized water. With this concentration, the fused silica etch rate is about 1 $\mu$m/h at 20° C. After the desired depth has been etched, the surface is rinsed with lots of deionized water to remove all fluorides from cracks and valleys to arrest the etching process. An acid rinse to remove metals that may produce insoluble fluorides could also be performed. However, the acid rinse is not necessary and may cause undesirable precipitation.

An alternative fluoride etch solution could contain 10% HF and 18.5% $NH_4F$, which will etch at a much faster rate of 8 μm/h. However, the control of the etch rate is important. An etch rate at this speed must be carefully monitored to avoid destroying the part. In addition, solutions with high HF concentrations are dangerous to work with and disposal of used solution is more difficult.

Figure 2C:
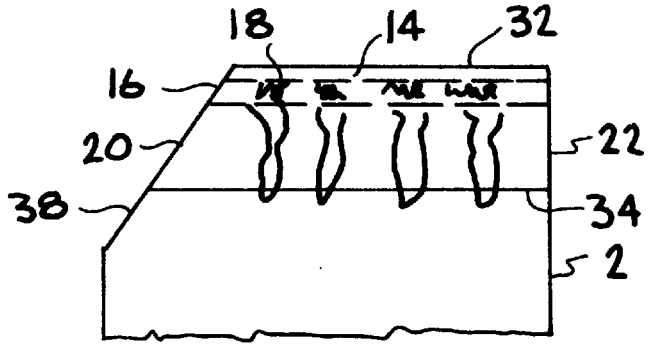
Figure 2D:
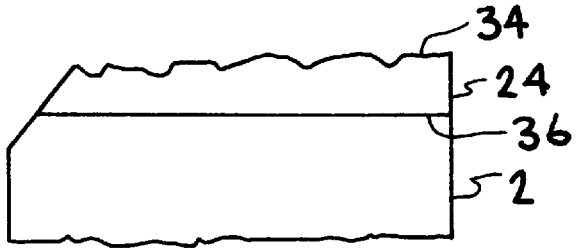

Referring to FIG. 2C, the part is shown with the surface 32 from the previous grinding step S6. The particles used in the slurry were about 9 μm and would be imbedded in the surface layer 14, which is around 10 μm thick. Usually subsurface damage is about three times the depth of the particles used in the grinding process of the previous step. Therefore, subsurface damage should reach to about 27–30 μm deep. These are shown as cracks and fractures in the subsurface damage layer 16. As the etching is performed, these cracks and fractures continue to be evenly etched into the part. Thus, the acidic fluoride solution will extend these cracks into the new surface 34 after the etching is complete. Referring to FIG. 2D, the surface 34 of the part will be pitted.

To determine how deep the subsurface damage is in the part, a conservative removal depth is recommended for the next step to assure elimination of subsurface damage. This conservative removal depth is 3.0 times the maximum particle size of the previous grinding step, where maximum particle size is defined for loose abrasive grinding as the 99th percentile of the particle size distribution, and is defined for high-grade commercial fixed diamond abrasive as 1.33 times the nominal mid-range particle size. For example, 60 microns is used as the maximum size of 320 grit fixed abrasive.

If significant experience, characterization and testing of parts, and quality control exist for a specific grinding process, then the removal depth required to reliably eliminate subsurface damage may for some grinding processes be titrated down to a more economical lower value, for example, as low as 1 or 2 times the maximum previous particle size.

In step S8 of FIG. 1, the bevels are repolished because a polish step of the surface may produce fine chips or sharp edges between the surface and the bevels. This corner should be made as smooth as possible to avoid producing these tiny chips that could scratch the surface of part if caught in the polishing slurry. It is recommended that the polish bevel angle be less than 45° to minimize scratches.

After a careful inspection, step S9 is performed to polish the surface by removing approximately 30 μm using a zirconia slurry. For example, a recirculating bowl feed polisher could be used at a spinning rate of 360 rpm and a normal loading of 300 g/cm$^2$. The zirconia slurry can be made by hand-mixing 5% by volume dry zirconia into deionized water and adjusting the pH to 8.5 with $NH_4OH$. Experiments used Fujimi FZ05 zirconia, which is quoted as 0.5 μm. However, zirconia with agglomerates of particle size distributions between 2 and 5 μm are acceptable. When the pH 8.5 is used, the agglomeration is reduced because the isoelectric point of the substrate and the polishing compounds is avoided. Experiments show that a pH 7.0 is acceptable and the suspension of zirconia in the slurry improves as the pH is raised to 8.5 or 9. However, lower pH levels (even as low as pH 4–5) would still work for polishing the surface of the part. In cases where other materials are to be polished, for example, CaF compounds, the pH of the slurry should be tuned to avoid the isoelectric point. The polish removal rates should be approximately 1 μm/h.

Figure 2E:
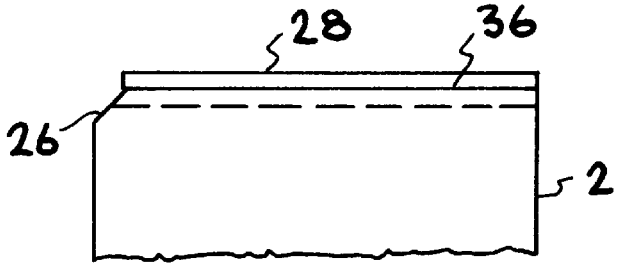

Referring to FIG. 2D, the 30 μm removal by the polishing step S9 would remove the pitted surface 34 of the part to the new surface 36. However, as shown in FIG. 2E, a re-deposit layer 28 may be deposited above this surface 36. This redeposit layer 28, which may be around 1.5 μm thick, may contain contaminants, residual polish, fused-glass particles, pitch and water.

Referring to FIG. 1, the final post polish etch could be performed as step S10 to remove 0.2 μm of the surface as well as the entire re-deposit layer 28. Although it is recommended to perform this etch, it is not necessary because the zirconia deposited on the surface would probably not interfere with the UV light. This post polishing etch, for example, could be a fluoride etch of 1% HF and 15% $NH_4F$ solution in deionized water. With this concentration, the etch rate is about 1 μm/h at 20° C. However, a more dilute fluoride etch may be preferred to control the etch. Because the depth is not large, fluoride etches will uniformly etch the surface. After the desired depth has been etched, the surface is rinsed with lots of deionized water to remove all fluorides remaining on the surface.

Once polished, the parts should be inspected for light scattering characteristics and inspected by microscope. In addition, the part can be measured for surface roughness, precision cleaned, laser damage tested, and imaged by Total Internal Reflection Microscopy (TIRM). For example, manual precision cleaning of optical parts used at a wavelength of 350 nm is performed by rubbing the part with dilute 0.05-μm Bakelox or equivalent alumina slurry, washing the part with aqueous FL70 surfactant, performing a deionized water rinse, and then performing an ethanol rinse on the part.

Figure 3:
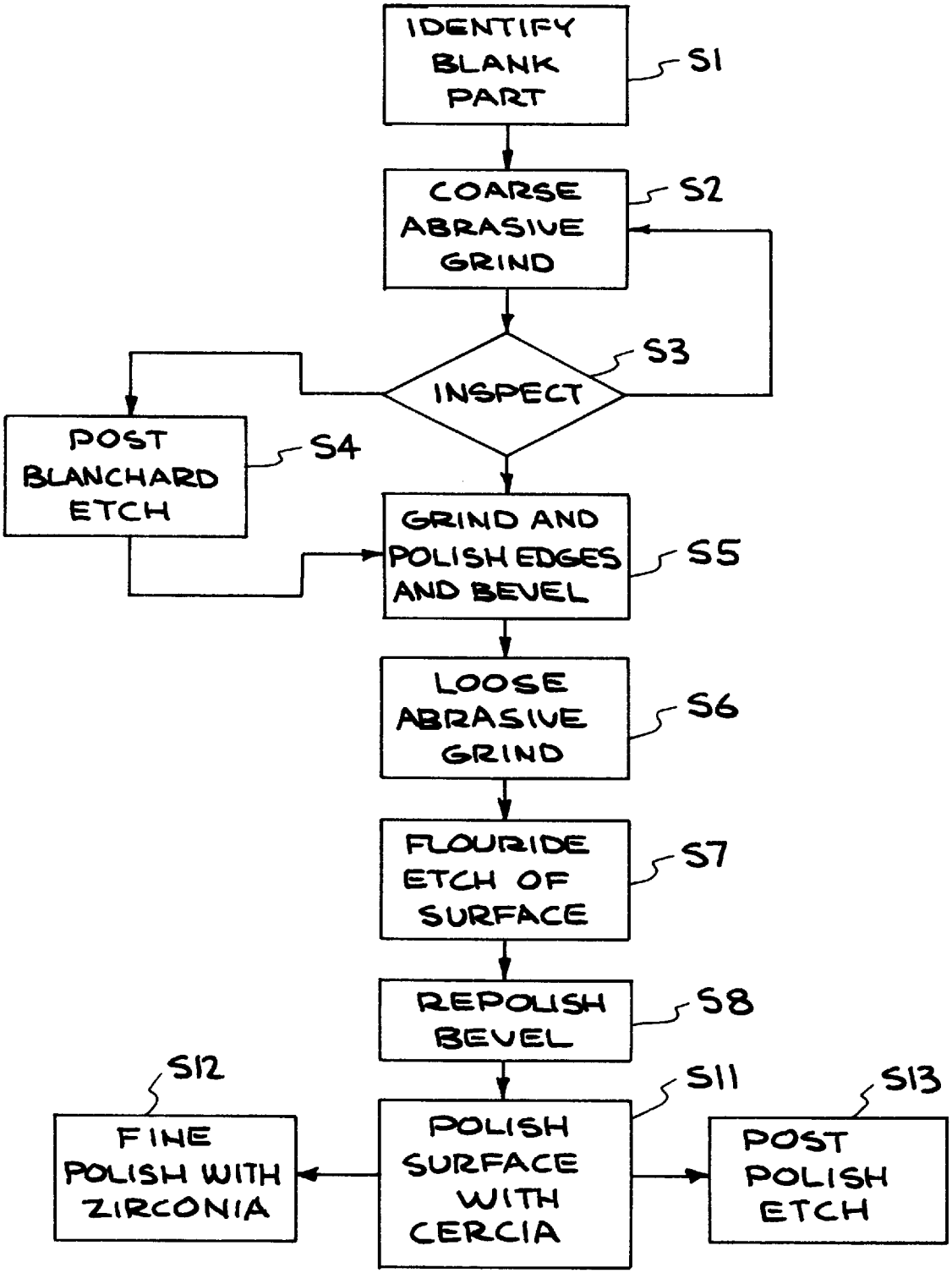
FIG. 3 is a flow diagram of the process used in the second preferred embodiment of the present invention.

The second preferred embodiment of the present invention will be described with reference to FIG. 3. Steps S1–S8 are performed in the same manner as described above for the first preferred embodiment. However, in step S11, a ceria ($CeO_2$) slurry will be used in the post etch polish instead of the zirconia slurry (step S9 of the first preferred embodiment) to remove 30 μm of the surface. For example, the polishing could be performed using a 48 inch polishing wheel (a Gugolz 82 pitch lap) rotating at 3 rpm with a polishing weight of 40 g/cm$^2$. A ceria slurry can be composed of one part Hastellite PO slurry and 10 parts deionized water. The ceria slurry is maintained at a pH 7.5 when polishing fused silica. Thus, the surface removal rate will be 1 μm/h when using this polishing device. This polishing rate is similar to the zirconia slurry polish of the first preferred embodiment.

Ceria is a strong absorber at 355-nm. Test have shown that ceria-polished surfaces typically have cerium concentrations of 10–100 ppm at the surface, decreasing to zero by 0.04–0.1 μm depth. Thus, all of the ceria compound should be easily removed from the surface. The grinding abrasives diamond and alumina are transparent at 355 nm. Many other elements are present in grinding and polishing slurries and are found in the top 0.05 μm at concentrations of 1–1000 ppm.

After the ceria slurry polish is complete, the part can be either post polished with a zirconia slurry to remove an additional 5 μm of the surface as shown in step S12 or a post polish etch could be performed as shown in step S13. Performing either of these steps will remove the ceria deposited in the surface of the part. An advantage of zirconia ($ZrO_2$) is that it is transparent at 355 nm. The preparation of the zirconia slurry polish of S12 would be similar to slurry used in step S9 of the first preferred embodiment. For example, the part would be placed in the recirculating bowl feed polisher and polished with the zirconia slurry, which is made from zirconia, deionized water and $NH_4OH$. Because only 5 μm of the surface at a rate of approximately 1 μm/h is being removed, the completion time of polishing several parts is reduced.

If step S13 is chosen as the preferred step in the process, then a fluoride etch would remove 0.2 μm of the surface in addition to the re-deposit layer of ceria from the polishing step S11. Similar to step S10 of the first preferred embodiment, the fluoride etch would contain HF and $NH_4F$ in deionized water such that the appropriate etch rate could be achieved. After the desired depth has been etched, the surface is rinsed with lots of deionized water to remove all fluorides remaining on the surface.

The final polished part should be inspected for any scratches or subsurface damage similar to the inspection performed in the first preferred embodiment.

Although the foregoing invention has been described in some detail by way of illustration for purposes of clarity of understanding, it will be readily apparent to those of ordinary skill in the art in light of the teachings of this invention that certain changes and modifications may be made thereto without departing from the spirit or scope of the appended claims.

It is claimed:

1. A method of polishing a blank used as an optical part comprising the steps of:

grinding said blank to remove a first subsurface damage layer in said blank, said first subsurface damage layer being formed during a fabrication of said blank;

polishing said blank by a minimum depth to remove a second subsurface damage layer in said blank, said second subsurface damage layer being formed by grinding particles used in said grinding step, said minimum depth being defined as a maximum particle size of said grinding particles contained within the 99th percentile of a particle size distribution; and cleaning said blank to remove any contaminants deposited during said polishing step.

2. The method of claim 1, wherein said minimum depth to polish is three times said maximum particle size.

3. The method of claim 1 further including an etching step after said grinding step, said etching step removing said grinding particles by etching said surface of said blank and removing a portion of said second subsurface damage layer.

4. The method of claim 3, wherein said etching step etching with fluoride solution composed of HF, $NH_4F$ and deionized water.

5. The method of claim 4 further including the steps of:

an edge polishing step to polish an edge of said blank, said edge polishing step being performed after completion of said coarse abrasive grinding step; and a bevel forming step to form a bevel between said surface and said edge of said blank, said bevel forming step being performed after said edge polishing step.

6. The method of claim 1, wherein said grinding step comprises the steps of:

a coarse abrasive grinding step to remove said first subsurface damage layer, said coarse abrasive grinding step forming a coarse grinding subsurface damage layer; and a loose abrasive grinding step for removing said coarse grinding subsurface damage layer, said loose abrasive grinding step forming said second subsurface damage layer.

7. The method of claim 6, wherein said loose abrasive grind uses an alumina slurry.

8. The method of claim 7, wherein said alumina slurry contains alumina having a particle size of 9 $\mu$m and said second subsurface damage layer will be approximately 30 $\mu$m deep.

9. The method of claim 1, wherein said polishing step uses a zirconia slurry to remove said second subsurface damage layer.

10. The method of claim 9, wherein said zirconia slurry is comprised of zirconia powder and deionized water.

11. The method of claim 10, wherein said zirconia slurry further includes $NH_4OH$ in sufficient concentration to maintain a pH in the range of 7 to 9.

12. The method of claim 11 further including an etch step after said zirconia polishing step to remove any residual zirconia deposited during said zirconia polishing step.

13. The method of claim 1, wherein said polishing step comprises the steps of:

a ceria polishing step using a ceria slurry to remove said second subsurface damage layer; and a zirconia polishing step to remove any residual ceria and contaminants deposited during said ceria polishing step.

14. The method of claim 1, wherein said polishing step comprises the steps of:

a ceria polishing step using a ceria slurry to remove said second subsurface damage layer; and an etching step to remove residual ceria and contaminants deposited during said ceria polishing step.

15. An optical part formed by the steps of:

grinding a blank to remove a first subsurface damage layer in said blank, said first subsurface damage layer being formed during a fabrication of said blank;

polishing said blank by a minimum depth to remove a second subsurface damage layer in said blank, said second subsurface damage layer being formed by grinding particles used in said grinding step, said second subsurface damage layer having a depth of at least a maximum particle size of said grinding particles contained within the 99th percentile of a particle size distribution; and cleaning said blank to remove any contaminants deposited during said polishing step.

16. The method of claim 15, wherein said blank is one of fused silica, CaF or silicon.

17. An optical part of claim 15 formed by an additional step of:

an etching step after said grinding step, said etching step removing said grinding particles by etching said surface of said blank and removing a portion of said second subsurface damage layer.

18. An optical part of claim 15 wherein said grinding step comprises the steps of:

a course abrasive grinding step to remove said first subsurface damage layer, said coarse abrasive grinding step forming a coarse grinding subsurface damage layer; and a loose abrasive grinding step for removing said coarse grinding subsurface damage layer, said loose abrasive grinding step forming said second subsurface damage layer.

19. An optical part of claim 18 formed by the additional steps of:

an edge polishing step to polish an edge of said blank, said edge polishing step being performed after completion of said coarse abrasive grinding step; and a bevel forming step to form a bevel between said surface and said edge of said blank, said bevel forming step being performed after said edge polishing step.

20. An optical part of claim 15 wherein said polishing step comprises the steps of:

a ceria polishing step using a ceria slurry to remove said second subsurface damage layer; and a zirconia polishing step to remove any residual ceria and contaminants deposited during said ceria polishing step.

* * * * *